United States Patent [19]

Meyer et al.

[11] 4,173,096

[45] Nov. 6, 1979

[54] WHEELED TOY

[75] Inventors: Burton C. Meyer, Downers Grove; Eugene Jaworski, Park Ridge, both of Ill.

[73] Assignee: Marvin Glass & Associates, Chicago, Ill.

[21] Appl. No.: 853,271

[22] Filed: Nov. 21, 1977

[51] Int. Cl.[2] ..... A63H 29/00

[52] U.S. Cl. ..... 46/205; 46/107

[58] Field of Search ..... 46/65, 68, 104, 107, 46/204, 205

[56] References Cited

U.S. PATENT DOCUMENTS

| | | | |
|---|---|---|---|
| 420,709 | 2/1890 | Wallace | 46/205 |
| 1,158,352 | 10/1915 | Williams | 46/65 |
| 1,253,449 | 1/1918 | Wilson | 46/205 |
| 1,543,143 | 6/1925 | Woznuk | 46/205 |
| 1,563,293 | 11/1925 | Santangelo | 46/204 |
| 1,648,352 | 11/1927 | Kroff | 46/204 |
| 1,665,578 | 4/1928 | Becker | 46/204 |
| 1,708,823 | 4/1929 | Arzig | 46/104 |
| 1,712,467 | 5/1929 | Arenc | 46/205 |
| 2,961,794 | 11/1960 | Sachs et al. | 46/65 X |
| 4,034,502 | 7/1977 | Breslow et al. | 46/204 |

FOREIGN PATENT DOCUMENTS

| | | | |
|---|---|---|---|
| 816811 | 10/1951 | Fed. Rep. of Germany | 46/107 |

*Primary Examiner*—F. Barry Shay

*Attorney, Agent, or Firm*—Mason, Kolehmainen, Rathburn & Wyss

[57] ABSTRACT

A wheeled toy is provided with a frame which includes a vertically extending post on the upper end of which is fixedly mounted an inverted cup-shaped member. The frame is supported for movement over a supporting surface by means of a pair of wheels which are journaled in the frame and are mounted nonsymmetrically with respect to said post, the frame including an elongated handle by means of which the toy may be rolled along a support surface. An inner member shaped similarly to the fixed cup-shaped member is rotatably mounted on the post and is driven directly by one of the wheels through an annular flange portion of the inner member which rests on the upper edge of said one wheel. This inner member includes a flange portion which extends outwardly beyond the bottom edge of the fixed cup-shaped member, a pair of cover members being biased to an upright position when the toy is at rest substantially to enclose the fixed cup-shaped member. As the toy is moved along a support surface, the inner member rotates and the hinged cover members open outwardly against the biasing force, due to the centrifugal force exerted thereon, so that the normally enclosed cup-shaped member becomes visible. The biasing force returns the cover members to their enclosing position when movement of the toy ceases.

14 Claims, 6 Drawing Figures

WHEELED TOY

BACKGROUND AND SUMMARY OF THE INVENTION

This invention is directed to a wheeled toy and, more particularly, to a wheeled toy which may be moved by children over a supporting surface, such as a floor, and during such movement wing-like cover members are whirled about and fly outwardly due to the action of centrifugal force, these wing-like cover members being automatically returned to an enclosing position over the main body of the toy when the toy is at rest.

Many types of wheeled toys have been a source of enjoyment for children for many years. For example, in U.S. Pat. No. 4,034,502, which is assigned to the same assignee as the present inventon, a wheeled push toy or trundle toy is disclosed wherein manual movement of the toy over a supporting surface, such as a floor, is employed to rotate an object-engaging surface and propel objects away from the toy as it is moved. Other examples of wheeled toys are shown in U.S. Pat. Nos. Des. 164,785; 1,366,841; 1,563,293; 1,648,352; 1,665,578; 2,641,083; 2,908,999; 420,709; 1,046,695; 3,191,343; 3,523,385; 3,708,912 and 3,996,692.

The present invention is directed to a wheeled push toy which is provided with a frame which includes a vertically extending post on the upper end of which is fixedly mounted an inverted cup-shaped member resembling the body of a bug. A pair of wheels are journaled in the frame for supporting the frame for rolling movement over a supporting surface, such as a floor, these wheels being mounted unsymmetrically with respect to the vertically extending post portion of the frame.

An inner member shaped similarly to the fixed cup-shaped member is rotatably mounted on the post and is connected to one of the wheels by means of an annular flange which rests on the upper edge of said one wheel. This inner member includes a flange portion which extends outwardly beyond the bottom edge of the fixed cup-shaped member, a pair of wing-like cover members being hingedly connected to said bottom edge and being spring biased to an upright position when the toy is at rest, thereby substantially to enclose the cup-shaped body portion of the frame. An elongated handle, which is connected to the frame and extends outwardly beneath the rotatable wing-like cover members, is provided for propelling the toy along a supporting surface. As the toy is moved along a supporting surface the inner member is rotated by engagement of one of the wheels therewith and the hinged wing-like cover members open outwardly against the biasing force exerted thereon, due to the centrifugal force of the rotating inner member, so that the normally enclosed cup-shaped body portion of the frame becomes visible. the biasing force returns the cover members to their enclosing position when movement of the toy ceases.

Other objects, features and advantages to the inventon will be apparent from the following detailed description taken in connection with the accompanying drawings.

DESCRIPTION OF THE PREFERRED EMBODIMENT

Figures 1, 2, 3, 4, 5, 6:
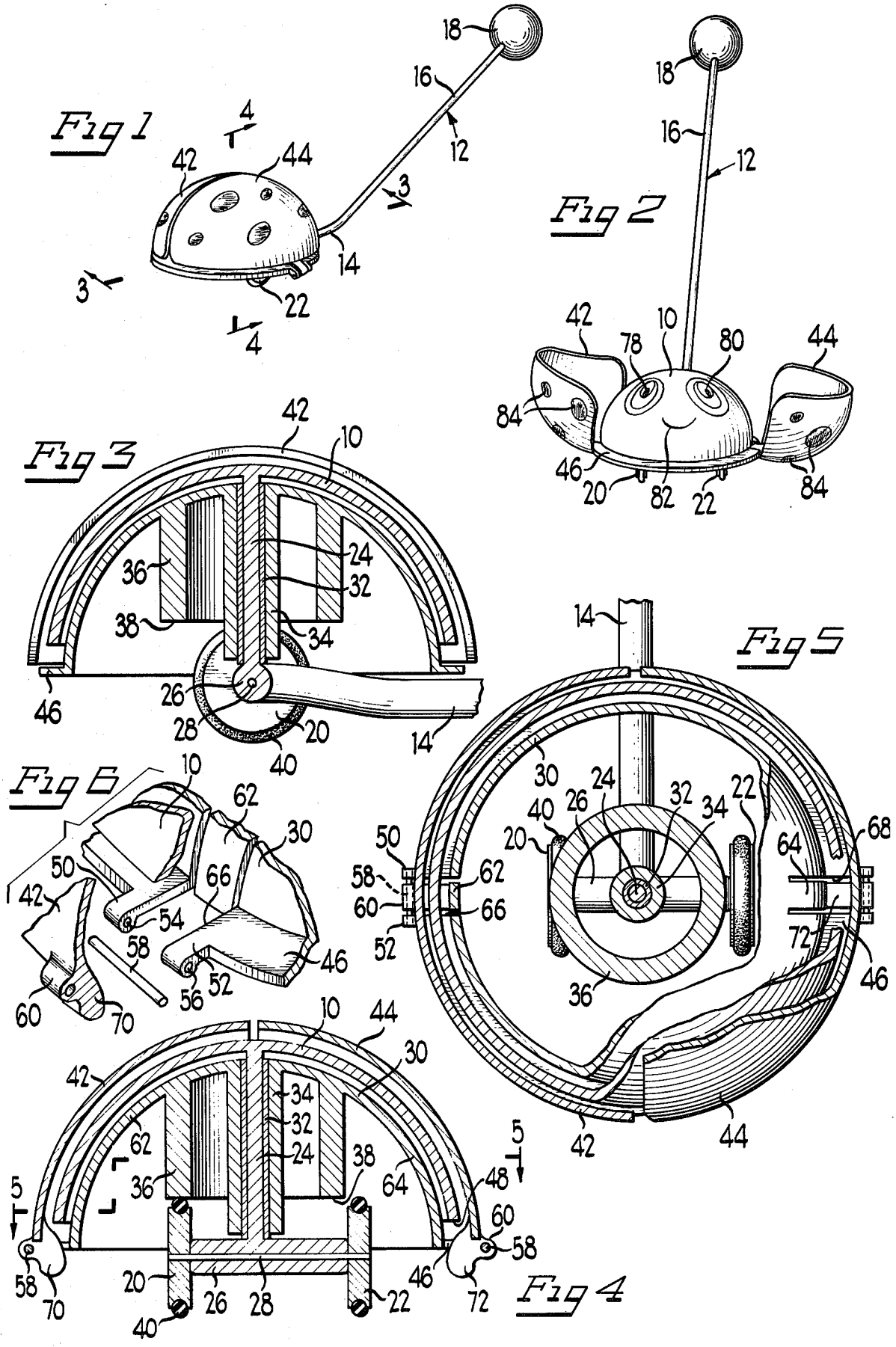
FIG. 1 is a perspective view of the toy of the present inventon and showing the wing-like cover members in enclosing position with the toy at rest.
FIG. 2 is a perspective view taken from the front of the toy and showing the wing-like cover members of the toy in open position as the toy is rolled over a supporting surface.
FIG. 3 is a sectional view taken along the lines 3—3 of FIG. 1.
FIG. 4 is a sectional view taken along the lines 4—4 of FIG. 1.
FIG. 5 is a sectional view taken along the lines 5—5 of FIG. 4.
FIG. 6 is a fragmentary exploded view, taken on a larger scale, of the hinge construction provided in accordance with the present invention for the wing-like cover members of the toy of FIG. 1.

The toy of the present invention, as exemplified by FIGS. 1 through 6 herein includes an inverted cup-shaped body portion 10 (FIG. 2) which forms a portion of the frame of the toy and is connected to an elongated handle indicated generally at 12. The handle 12 comprises a rearwardly extending portion 14 which extends generally parallel to the floor and an upwardly inclined portion 16 which terminates in a knob or ball end portion 18 which may be grasped by the child so that the toy may be moved over a supporting surface. The inverted cup-shaped body portion 10 is supported by means of a pair of rubber-tired wheels 20, 22 so that the toy may be rolled along the floor.

More particularly, the inverted cup-shaped body portion 10 is connected to a central vertically-extending post portion 24 which has formed integrally with the bottom end thereof a transversely extending portion 26 which carries an axle 28 on which the wheels 20 and 22 are mounted. The horizontally-extending portion 14 of the handle 12 is formed integrally with the transversely-extending axle portion 26 of the frame. Preferably, the entire frame consisting of the cup-shaped portion 10, the post 24, the transverse axle portion 26 and the handle 12 may be formed of suitable plastic material in a single molding operation.

An inner member 30, which is also of inverted cup-shaped construction and conforms to the contour of the body portion 10, is rotatably mounted on the vertically extending post 24 of the frame.

More particularly, a sleeve bearing 32 is positioned around the post 24, and the inner member 30 is provided with a central vertically extending bearing portion 34 which extends along the length of the bearing 32 so that the member 30 is freely rotatable about the post 24.

In order to rotate the member 30 in a simple and economical manner while concealing the driving means for achieving such rotation, the member 30 is provided with an annular downwardly extending flange portion 36 which is concentric with the post 24, and terminates in a flat, bottom annular surface 38 which rests on the rubber-tire portion 40 of the wheel 20. The transversely extending axle portion 26 of the frame is not symmetric with respect to the post 24 so that only the wheel 20 which is closest to the post 24 engages the annular flange 38 while the other wheel 22 is positioned outside the periphery of the flange 36 of the rotatable inner member 30. With such an arrangement, the member 30 rests on the upper portion of the one driving wheel 20. Accordingly, when the toy is moved over a supporting surface and the wheel 20 rotates the inner member 30 is directly rotated by engagement of the rubber tire 40 with the annular flange driving surface 38 of the member 30.

In accordance with a further aspect of the invention, a pair of wing-like cover members 42 and 44 are hingedly connected to a bottom flange portion 46 of the inner rotatable member 30 at diametrically opposite points on this flange. The flange portion 46 extends outwardly beneath the bottom edge 48 of the fixed body member 10 so that the members 42, 44 may cover the body member 10 and yet may be rotated with respect thereto. More particularly, flange portion 46 is provided with the outwardly extending arm portions 50 and 52 (FIG. 6) which are provided with aligned apertures 54, 56 for receiving a transversely extending hinge pin 58, the pin 58 extending through an outwardly-extending boss portion 60 of the wing-like cover member 42. The cover member 44 is similarly connected to the opposite side of the flange 46 so that both of the cover members 42, 44 are hingedly connected to the outer edge portions of the rotatable member 30 and are adapted to rotate about the horizontal axes formed by the hinge pins 58.

In accordance with a further important aspect of the invention, the hinged cover members 42, 44 are maintained in the upright position shown in FIG. 1 in which position they substantially totally enclose the body portion 10 while permitting the cover members 42, 44 to fly outwardly due to the action of centrifugal force, when the toy is moved over a supporting surface and the inner member 30 is rotated by engagement of the wheel 20 therewith. More particularly, the opposed edge portions of the inner member 30 are provided with vertical slots which extend upwardly from the bottom edge thereof and define a pair of opposed flexible tongue portions 62, 64 (FIGS. 5 and 6). A pair of corresponding slots 66, 68 are formed in the flange portion 46 of the rotatable inner member 30 to provide clearance for an inwardly extending cam portion 70, 72 formed in the opposed cover members 42, 44 adjacent the hinge pins 58. The cam portions 70, 72 extend into the slot 66, 68 and may contact the outer edge of the tongue portions 62, 64 when the cover members 42, 44 are in the upright enclosing position, as best illustrated in FIG. 4. However, when the member 30 is rotated the wing-like cover members 42, 44 open outwardly as they are pivoted about the hinge pins 58 so as to expose the inverted cup-shaped body portion 10. As the cover members 42, 44 are pivoted about the hinge pins 58 the cam portions 70, 72 deflect the flexible tongue portions 62, 64 inwardly. Accordingly, when movement of the toy ceases the tongue portions 62, 64 acting on the cam portions 70, 72 function to pivot the cover members 42, 44 about their hinge pins 58 and return these cover members to their enclosing upright position, as shown in FIG. 1.

Preferably, the body portion 10 may have a suitable artistic design thereon, such as the illustrated eyes 78, 80 and mouth 82. Also, the wing-like cover members 42, 44 may be provided with spots 84 thereon to provide a realistic design simulating the wings of a bug when the body portion 10 is enclosed thereby. If desired, the inverted cup-shaped body portion 10 may be of translucent or transparent material and the adjacent outer surface of the inner rotatable member 30 may be provided with a suitable design which is visible through the transparent or translucent body portion 10 when the member 30 is rotated, and the cover members 42, 44 are open. It will also be understood that the shape of the inner member 30 may vary considerably from that shown if this member is not to be visible through the body of the fixed body member 10, as will be readily understood by those skilled in the art.

In operation, a user grasps the knob 18 and moves the toy over a supporting surface, such as a floor. As the wheels 20, 22 rotate, the tire 40 drives the inner member 30 and rotates the closed cover members 42, 44 so that they fly outwardly by centrifugal force and expose the top surface of the body portion 10 to view. When motion of the toy ceases, spring arms 62, 64 exert an outward biasing force on the cam portions 70, 72 of the cover members 42, 44 so that these members are returned to their upright enclosing position, as shown in FIG. 1.

The foregoing detailed description is given for clearness of understanding only and no unnecessary limitation should be understood therefrom as some modifications will be obvious to those skilled in the art.

What is claimed as new and desired to be secured by Letters Patent of the United States is:

1. A wheeled toy, comprising: a frame including a vertically extending post, wheel means journaled in said frame for rollingly supporting said frame for movement over a support surface, an elongated handle connected to said frame and adapted to be grasped by a user for manually moving the toy over the support surface, a body portion fixedly connected to the upper end of said post, an inner member rotatably mounted on said post beneath said body portion and having an edge portion extending beyond the periphery of said body portion, drive means interconnecting said wheel means and said inner member so that said inner member is rotated as the toy is rolled over a support surface, at least one cover member pivotally connected to said edge portion of said inner member, and means for normally positioning said cover member over said body portion while permitting said cover member to move outwardly by centrifugal force when said inner member is rotated as the toy is moved over a support surface.

2. The wheeled toy of claim 1 which includes a pair of cover members pivotally connected to said edge portion of said inner member at diametrically opposed points thereon, and said positioning means comprising means associated with said pair for normally positioning said cover members in an upright position when the toy is at rest so that said cover members substantially enclose said body portion of said frame while permitting said cover members to move outwardly and expose said body portion by virtue of the centrifugal force exerted on said cover members when said inner member is rotated as the toy is moved over a support surface.

3. The wheeled toy of claim 1, wherein said cover member is pivotally mounted for movement about a generally horizontal axis.

4. The wheeled toy of claim 2, wherein said cover members are pivotally mounted on said inner member for movement about generally horizontal axes.

5. The wheeled toy of claim 1, wherein said wheel means includes a pair of wheels which are nonsymmetrically positioned with respect to said post, and said drive means includes an annular flange portion on said inner member which is concentrically positioned with respect to said post and is in engagement with only one of said pair of wheels.

6. The wheeled toy of claim 5, wherein said inner member is rotatably supported on said post by engagement of said annular flange portion thereof with the upper edge of said one wheel.

7. The wheeled toy of claim 6, wherein said annular flange portion is urged into engagement with the upper edge of said one wheel by virtue of the weight of said inner member and said cover member so that positive traction is provided between said one wheel and said inner member.

8. The wheeled toy of claim 7, wherein said one wheel is provided with rubber tire means, thereby to increase the traction between said one wheel and said annular flange portion of said inner member.

9. A wheeled toy, comprising: a frame, wheel means journaled in said frame for rollingly supporting said frame for movement over a support surface, a first member mounted on said frame for rotation about a generally vertical axis, drive means interconnecting said wheel means and said first member so that said member is rotated about said vertical axis as the toy is moved over a support surface, a second member pivotally connected to the outer edge portion of said first member, and means for positioning said second member in a first position relative to said first member when the toy is at rest while permitting said second member to move outwardly by centrifugal force when the toy is moved over a support surface and said first member is rotated.

10. A wheeled toy as set forth in claim 9, wherein said last named means comprises a flexible member carried by said first rotatable member and positioned normally to engage said second member and hold said second member in said first position, said flexible member permitting said second member to move outwardly by centrifugal force when said first member is rotated and returning said second member to said first position when rotation of said first member ceases.

11. A wheeled toy as set forth in claim 9, wherein said second member is mounted on said outer edge portion of said first member for rotation about a generally horizontal axis and is provided with an inwardly extending cam portion, and said positioning means comprises a flexible member carried by said first member and positioned to engage said cam portion of said second member and hold said second member in said first position when the toy is at rest.

12. A wheeled toy, comprising: a frame including a pair of wheels journaled in said frame at points which are unsymmetrical with respect to said post for rollingly supporting said frame for movement over a support surface, a rotatable member mounted on said frame, means defining an annular flange on said rotatable member which is concentric with said post and is in engagement with only one of said pair of wheels, and at least one cover member pivotally connected to said rotatable member, whereby rotation of said one wheel as the toy is moved over a support surface is effective to cause rotation of said rotatable member and outward pivotal movement of said cover.

13. The wheeled toy of claim 12, wherein said rotatable member is rotatably supported on said post by engagement of said annular flange portion thereof with the upper edge of said one wheel.

14. The wheeled toy of claim 13, wherein said one wheel includes a rubber tire which is in engagement with said annular flange portion of said rotatable member.

* * * * *